US012618554B2

(12) United States Patent
Li et al.

(10) Patent No.: US 12,618,554 B2
(45) Date of Patent: May 5, 2026

(54) BURNER COMPONENT AND BURNER

(71) Applicant: DALIAN INSTITUTE OF CHEMICAL PHYSICS, CHINESE ACADEMY OF SCIENCES, Dalian (CN)

(72) Inventors: Weizhen Li, Dalian (CN); Jingcai Zhang, Dalian (CN); Tao Zhang, Dalian (CN)

(73) Assignee: DALIAN INSTITUTE OF CHEMICAL PHYSICS, CHINESE ACADEMY OF SCIENCES, Dalian (CN)

( * ) Notice: Subject to any disclaimer, the term of this patent is extended or adjusted under 35 U.S.C. 154(b) by 558 days.

(21) Appl. No.: 18/000,720

(22) PCT Filed: Nov. 29, 2021

(86) PCT No.: PCT/CN2021/133948
§ 371 (c)(1),
(2) Date: Dec. 5, 2022

(87) PCT Pub. No.: WO2022/096022
PCT Pub. Date: May 12, 2022

(65) Prior Publication Data

US 2023/0220991 A1 Jul. 13, 2023

(30) Foreign Application Priority Data

Nov. 3, 2020 (CN) ..... 202011211686.0
Nov. 3, 2020 (CN) ..... 202022511767.4

(51) Int. Cl.
*F23D 14/04* (2006.01)
*F23D 14/62* (2006.01)

(52) U.S. Cl.
CPC ..... *F23D 14/04* (2013.01); *F23D 14/62* (2013.01)

(58) Field of Classification Search
None
See application file for complete search history.

(56) References Cited

U.S. PATENT DOCUMENTS 1,259,029 A * 3/1918 Lucke ..... F23D 14/145 48/74
3,825,403 A * 7/1974 Gottschall ..... F23D 14/145 431/328

(Continued)

FOREIGN PATENT DOCUMENTS

CN 2596231 Y 12/2003
CN 107166387 A 9/2017

(Continued)

OTHER PUBLICATIONS

Du, Yongming, "Modern Gas/Oil-fired Boiler User Manual", Mar. 31, 2003, China Dadi Publishing House, pp. 288, ISBN 7800975525.

*Primary Examiner* — Jorge A Pereiro
(74) *Attorney, Agent, or Firm* — NKL Law; Allen Xue

(57) ABSTRACT

A burner contains a burner component. The burner component includes a main frame and at least one stable burning isolation strip. An interior of the main frame is divided into at least two ventilation areas by the stable burning isolation strip in a gas channel direction. Several separation mechanisms are arranged in each ventilation area and divide the ventilation area into several through holes distributed in the gas channel direction. The through holes are used for a mixed gas of fuel gas and air to pass through and enhancing a mixing effect of the fuel gas and the air. The flame of a burning surface of the main frame can be divided into (Continued)

independent flames by the stable burning isolation strip so that the burning is more stable and fewer pollutants are emitted.

10 Claims, 5 Drawing Sheets

(56) References Cited

U.S. PATENT DOCUMENTS

| | | | | | |
|---|---|---|---|---|---|
| 5,439,372 | A * | 8/1995 | Duret | F23D 14/126 | 431/328 |
| 5,490,778 | A * | 2/1996 | Meijer | F23D 14/06 | 431/328 |
| 2004/0086818 | A1 * | 5/2004 | Kruper | F23D 14/145 | 431/328 |

FOREIGN PATENT DOCUMENTS

| | | | | | |
|---|---|---|---|---|---|
| CN | 108006629 | A | | 5/2018 | |
| CN | 208871625 | U | | 5/2019 | |
| CN | 112128805 | A | | 12/2020 | |
| CN | 112212327 | A | | 1/2021 | |
| CN | 112212328 | A | | 1/2021 | |
| CN | 213577479 | U | | 6/2021 | |
| CN | 213577600 | U | | 6/2021 | |
| CN | 213578067 | U | | 6/2021 | |
| CN | 213578068 | U | | 6/2021 | |
| CN | 214249581 | U | | 9/2021 | |
| CN | 214275834 | U | | 9/2021 | |
| CN | 214581061 | U | | 11/2021 | |
| EP | 0679839 | A1 | | 11/1995 | |
| JP | 08320109 | A | * | 12/1996 | |
| WO | WO-9527871 | A1 | * | 10/1995 | F23D 14/12 |

* cited by examiner

| | Gas water heater /wall-hanging | Gas stove | Gas boiler Burning machine | Flame form | Color | Emission |
|---|---|---|---|---|---|---|
| Traditional burner | 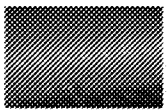 | 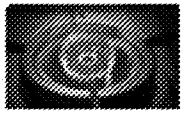 | 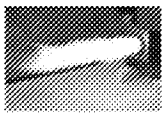 | Long outer flame and short inner flame | Blue (azure, whitish) with high air-fuel ratio; yellow with low air-fuel ratio | $NO_x > 140$ mg/Nm$^3$ CO > 200 ppm |
| Full-premixed surface burner | 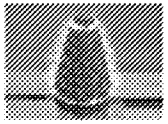 |  | 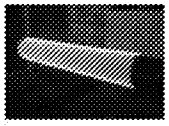 | Only short inner flame | Blue (azure, whitish) | $NO_x < 30$ mg/Nm$^3$ CO < 30 ppm |
| Infrared burner | 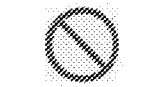 | 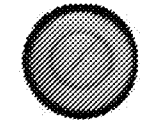 | 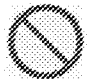 | No obvious flame | Red | ======= |
| Blue flexible burner | 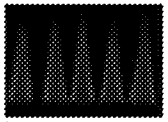 | 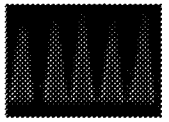 | 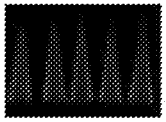 | Only long outer flame | Blue | $NO_x < 15$ mg/Nm$^3$ CO < 10 ppm |

FIG. 6

BURNER COMPONENT AND BURNER

TECHNICAL FIELD

The present disclosure relates to the technical field of combustion apparatuses, in particular to a burner component and a burner.

BACKGROUND

Burner is a general name for devices injecting fuel and air in a certain manner for mixed burning. Burners are divided into industrial burners, burning machines, civil burners and special burners according to types and application fields. The burners commonly used at home include gas boilers, gas stoves, high-fire gas stoves, infrared gas stoves, and burning heads of gas water heaters.

The gas boiler has the power of 200 kW or more, fuel gas is sprayed out of a small hole and mixed with air blown into a large barrel by a fan, and then is ignited to form an integral cylindrical conical flame. As for a traditional burning head, fuel gas is mixed with air in a burning disc and ignited, which belongs to diffusion flame burning. The traditional burning head has simple structure, mature technology, low cost, but the high CO and $NO_x$ emission concentration. A main body of a full-premixed metal fiber surface burning head is a temperature-resistant metal fiber net and needs to cooperate with a full-premixed fan and a valve group for use, which shortens a flame length to avoid a local high temperature and shorten burning time, so as to reduce nitrogen. As for this surface burning head, although the CO and $NO_x$ emission concentration is low, but the cost is high and has defects such as burner blocking and tempering risks. A staged burning head (bias burning head) introduces air or fuel into a furnace in multiple stages to burn, which generates a reducing atmosphere to reduce generated $NO_x$ into $N_2$, so as to reduce nitrogen. The staged burning head has relatively complex structure, mature technology, high cost, limited nitrogen reduction effect (ultralow emission is difficult to achieve), and high CO emission concentration.

The gas stove has the power of 3-5 kW. After pipeline fuel gas ejects air, the air is ejected from small holes arranged at an inner disc and an outer ring, and flame is divided into two layers after ignition: a rich-burning premixed burning flame is formed inside by the fuel gas and the ejected air, and a diffusion burning flame is formed outside by residual fuel and ambient air. As for a traditional cooking range, fuel gas ejects primary air into a cooking range structure for mixing, premixed gas is ignited followed by contacting with secondary air through diffusion to complete a burning process. The traditional cooking range has simple structure, mature technology, low cost, but low heat efficiency and high CO and $NO_x$ emission concentration. A burning disc of the infrared gas stove is a porous ceramic plate, fuel gas ejects air into a cooking range for mixing, the ceramic disc is heated through flame burning to be converted into infrared burning. However, ceramic is prone to damage, insufficient combustion gas easily causes insufficient burning, the cost is high, the heat efficiency is high, and the $NO_x$ and CO emission concentration is high. The cooking range structure of the high-fire gas stove is not special and requires high fuel gas pressure, combustion air is generally supplied by ejection or a fan. The high-fire gas stove has simple structure, the mature technology, low cost, but low heat efficiency and high CO and $NO_x$ emission concentration.

The high-fire gas stove has the power of 5-30 kW. After being mixed in a pipeline, pipeline fuel gas and air blown out by a fan are sprayed out from holes arranged in an inner disc and an outer ring and are ignited to form an oxygen-enriched flame with high fire power and temperature, but the mixed gas burn insufficiently and CO and $NO_x$ emission concentration is high.

The infrared gas stove has the power of 3-5 kW. After pipeline fuel gas ejects air and is ignited from an upper surface of a honeycomb disc, the flame retracts into the honeycomb channels for short-flame burning, and the honeycomb body is heated to form a high-temperature heat accumulator to emit infrared rays for heating. Infrared burner is basically the same as the infrared gas stove in structure and features and mainly carries out burning in a channel, its power is limited and the structure is prone to damage.

The water heater and the wall-hanging stove have the power of 20-70 kW. Fuel gas and part of air blown by a fan enter a fire grate and then are sprayed out from small holes, a rich-burning premixed cluster flame is formed after ignition, and fuel which is not completely burned and the remaining part of air sprayed out through gaps of the fire grate continue to be diffused and burned. As for a traditional tobacco pipe type fire grate, fuel gas ejects primary air into a tobacco pipe structure for mixing, premixed gas is ignited followed by contacting with secondary air by means of diffusion so as to complete a burning process. It has simple structure, mature technology, low cost, but high CO and $NO_x$ emission concentration. The structure of a bias fire grate is similar to the tobacco pipe type fire grate, which makes a reducing atmosphere through staged burning to reduce $NO_x$ into $N_2$ so as to reduce nitrogen. It has complex structure and high cost; although the $NO_x$ emission concentration is low, the CO emission concentration is high. A water-cooled fire grate is mainly a combination of a traditional fire grate and a water-cooled copper pipe, which reduces the flame temperature through heat exchange to reduce nitrogen. It has mature technology low $NO_x$ emission concentration, but high cost, complex structure and high CO emission concentration. A main body of a full-premixed metal fiber surface burner is a temperature-resistant metal fiber net and needs to cooperate with a full-premixed fan and a valve group for use, which shortens a flame length to avoid a local high temperature and shorten burning time, so as to reduce nitrogen. It has low CO and $NO_x$ emission concentration, but has defects such as high cost, burner blocking and tempering risks.

CN 108006629A of "Combustor and Gas Water Heater with Same" disclosed a combustor comprising a first rich combustion cavity, a second rich combustion cavity and a poor combustion cavity. However, one of the combustion units actually only forms one flame as a whole. The middle part of the flame is a lean burning flame and two sides of the flame are rich burning flames. Unburned fuel of the rich burning flame and surplus oxygen of the lean burning flame are converged at the tail end of the flame to subject to secondary combustion. The first blind path and the second blind path are arranged to separate the rich flame and the lean flame and cannot separate the whole flame.

In conclusion, the existing mature technology with low manufacturing cost of a burning assembly is high in pollutant emission and not beneficial to environmental protection; and a technology with relatively low pollutant emission is unfavorable for popularization due to overhigh manufacturing cost.

SUMMARY OF THE INVENTION

According to the above-mentioned technical problems, it's an object of the present disclosure to provide a burner component and a burner having a desirable burning effect, fewer pollutants discharged and low manufacturing cost. The present disclosure employs the following technical solution:

A burner component includes a main frame and at least one stable burning isolation strip, wherein an interior of the main frame is divided into at least two ventilation areas by the stable burning isolation strip in a gas channel direction, a plurality of separation mechanisms are arranged in each ventilation area and divide the ventilation area into a plurality of through holes distributed in the gas channel direction. The through holes are used for a mixed gas of fuel gas and air to pass through and strengthening a mixing effect of the fuel gas and the air. A burning flame of a burning surface of the main frame may be separated to form mutually independent flames by the stable burning isolation strip, and a width D1 of the stable burning isolation strip is equal to a total length of 3 to 10 through holes.

Further, the stable burning isolation strip is attached to a surface of the main frame, or penetrates the main frame in a thickness direction, or extends into the main frame by a preset length.

Further, the stable burning isolation strip is fixed on the main frame, and the ventilation areas are embedded in the main frame; alternatively, the ventilation areas are fixed on the main frame, and the stable burning isolation strip is attached to the main frame; and alternatively, the ventilation areas are fixed on the stable burning isolation strip, and the ventilation areas and the stable burning isolation strip are integrally fixed on the main frame, or an integral structure is integrally formed.

Further, a single through hole has a cross-sectional area of $S_{hole}$ satisfying $0.1\ mm^2 \leq S_{hole} \leq 9\ mm^2$.

Further, the stable burning isolation strip is continuous or discontinuous, and a discontinuous section has a width $D_2$ equal to a total length of one or two through holes.

Further, the stable burning isolation strip has a width $D_1$ satisfying $2\ mm \leq D_1 \leq 50\ mm$.

Further, the ventilation areas are formed by patches of continuous through holes, and the ventilation area has a cross-sectional area $S_n$ satisfying $30\ mm^2 \leq S_n \leq 22500\ mm^2$.

Further, a hole wall thickness, that is, a thickness $d_{hole}$ of the separation mechanism satisfies $0.03\ mm \leq d_{hole} \leq 3\ mm$, and the main frame has a wall thickness $d_{outer}$ satisfying $0.03\ mm \leq d_{outer} \leq 50\ mm$.

Further, the ventilation area has a thickness/height h satisfying $4\ mm \leq h \leq 1000\ mm$.

The present disclosure also provides a burner comprising the said burning component.

In the present disclosure, power of the burner component may be changed along with an area of the burner. The fuel gas and the air blown into the fan enter a micro-channel to be thoroughly and uniformly mixed and then ignited to form uniform premixed flames after being, sprayed out of the micro-channel. Since the isolation strip is arranged, the flames are independent of each other, each separated flame is of a pyramid-like shape (a flame surface is of a hollow cone shape), and the flames are stable, so that an erratic continuous flame is effectively avoided, and the burning is stable. Pore density of the micropores in the present disclosure is large, and the pore diameter is limited. Limited space in the micropores has a rectification effect, mixing the fuel gas and the air being well, so that the CO and $NO_x$ emission is very low and is 10 ppm below, which is clean and efficient. Further, the arrangement of the micropores has an anti-backfire function. A micro-channel structure in the field of catalyst carriers is applied to the field of burning, such that no large-specification transformation of an existing appliance is needed, thus the cost is reduced.

DETAILED DESCRIPTION OF DRAWINGS

In order to more clearly illustrate technical solutions in the embodiments of the present disclosure or in the prior art, a brief introduction to the accompanying drawings required for the description of the embodiments or the prior art will be provided below. Obviously, the accompanying drawings in the following description are some of the embodiments of the present disclosure, and those ordinary skilled in the art would also be able to derive other drawings from these drawings without making creative efforts.

FIG. 6 is a comparison diagram of a specific embodiment using the present disclosure to the prior art.

Figure 1:
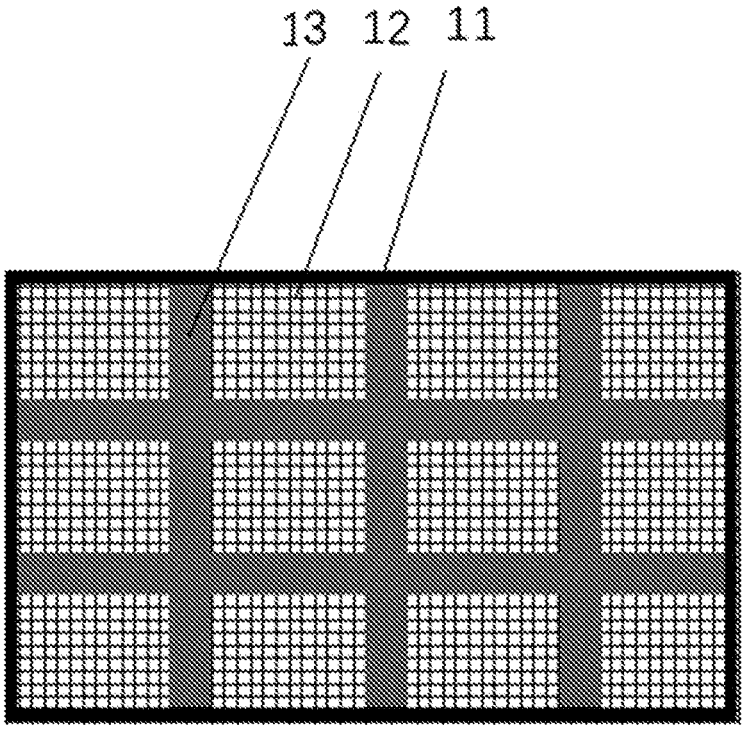
FIG. 1 is a simple structural schematic diagram of Embodiment 1 of the present disclosure.

In the figures: 1. housing; 2. air distributor; 3. micro-channel rectifier; 4. micro-channel flow-adjustment burner; 5. ignition needle; 6. gas inlet; 7. first gas pressure equalizing mixing cavity; 8. second gas pressure equalizing mixing cavity; 9. flame; 11. main frame; 12. through hole; 13. stable burning isolation strip.

DETAILED DESCRIPTION OF PREFERRED EMBODIMENTS

To make the objectives, technical solutions and advantages of embodiments of the present disclosure more obvious, the technical solutions of the present disclosure will be clearly and completely described below in conjunction with the accompanying drawings in the embodiments of the present disclosure, and obviously, the described embodiments are some, rather than all of the embodiments of the present disclosure. Based on the embodiments of the present disclosure, all other embodiments acquired by those of ordinary skilled in the art without making creative efforts fall within the scope of protection of the present disclosure.

The present disclosure discloses a burner component including a main frame 11 and at least one stable burning isolation strip 13. An interior of the main frame is divided into at least two ventilation areas by the stable burning isolation strip in a gas channel direction. A plurality of separation mechanisms are arranged in each ventilation area and divide the ventilation area into a plurality of through holes 12 distributed in the gas channel direction. The through holes are used for a mixed gas of fuel gas and air to pass through and strengthening a mixing effect of the fuel gas and the air. A burning flame of a burning surface of the main frame may be separated to form mutually independent flames by the stable burning isolation strip.

The structure of the present disclosure includes a variety of forming method, such as the stable burning isolation strip is fixed on the main frame, and the ventilation areas are embedded in the main frame; alternatively, the ventilation areas are fixed on the main frame, and the stable burning isolation strip is attached to the main frame; and alternatively, the ventilation areas are fixed on the stable burning isolation strip, and the ventilation areas and the stable burning isolation strip are integrally fixed on the main frame, or an integral structure is integrally formed.

In a process that fuel gas is input into the gas channel in the main frame by an air blower/exhaust fan, there are many directions for the entering gas. Under the condition that the area of ventilation areas is too large, a flame connecting phenomenon is prone to occurring, and therefore the single ventilation area having an area small enough is required. When the embodiment is used in various fields, the cross-sectional area of the single through hole may be different, but it should be guaranteed that the single through hole has a cross-sectional area $S_{hole}$ satisfying 0.1 $mm^2 \leq S_{hole} \leq 9$ $mm^2$. According to different manufacturing processes or other possible influencing factors, a certain defective rate, non-uniform pore sizes, or specifications of a certain number of pores exceeding a range of the present disclosure may be considered to be within the scope of protection of the present disclosure. The ventilation areas have a thickness/height h satisfying 4 mm≤h≤1000 mm. Different through holes may have equal heights or not, upper surfaces and lower surfaces of the holes may be planar or not, but it needs to be guaranteed that after entering the micropores, the mixed gas of fuel gas and air may continuously collide at the pore walls of the micropores and mix due to limitation of a pore volume, and then a output direction of the fuel gas at the output end of the gas channel is a straight line. The micropores have an effect of mixing and rectification in the process, such that the burning efficiency of the flame is further enhanced.

The stable burning isolation strip has a width $D_1$ satisfying 2 mm≤$D_1$≤50 mm.

The ventilation areas are formed by patches of continuous through holes, and each ventilation area has a cross-sectional area $S_n$ satisfying 30 $mm^2 \leq S_n \leq 22500$ $mm^2$.

A hole wall thickness, that is, a thickness $d_{hole}$ of the separation mechanism satisfies 0.03 mm≤$d_{hole}$≤3 mm, and the main frame has a wall thickness $d_{outer}$ satisfying 0.03 mm≤$d_{outer}$≤50 mm.

Figure 7:
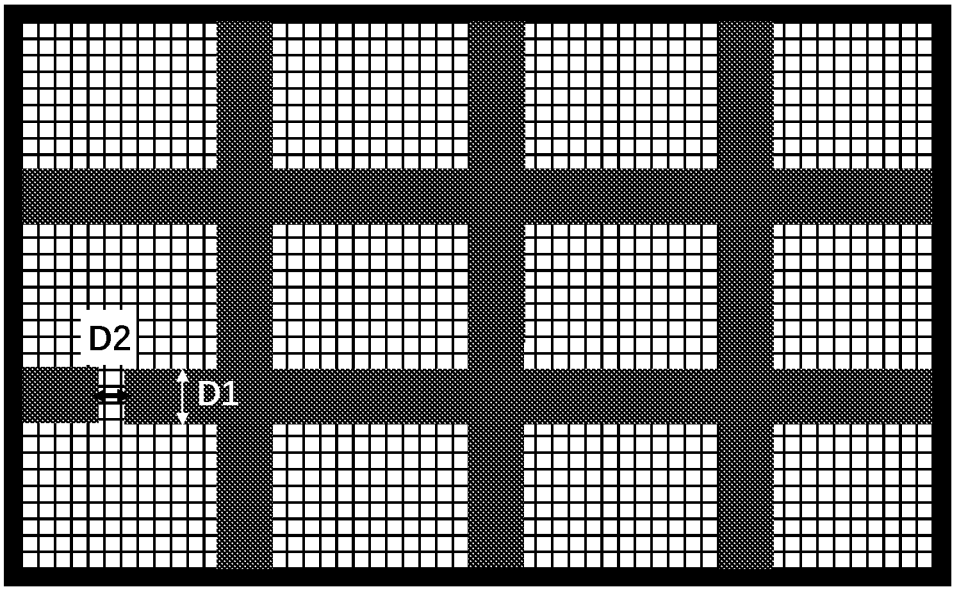
FIG. 7 is a schematic diagram illustrating a non-continuous state of a stable burning isolation strip in an embodiment of the present disclosure.

FIG. 1 shows a shape of a burner component of Embodiment 1. The main frame is rectangular, and the internal stable burning isolation strips are elongated shape, which divides the interior of the rectangle into a plurality of uniform areas, and flames of adjacent pores are of pyramid-like shape (flame surfaces are of hollow cone shape). As shown in FIG. 7, in other optional embodiments, the areas divided in the interior of the rectangle may be different in area, the stable burning isolation strip may also be discontinuous, but it needs to be guaranteed that the stable burning isolation strip has a width $D_1$ equal to a total length of 3 to 10 through holes and a discontinuous section has a width $D_2$ equal to a total length of 1 or 2 through holes. The separation mechanism may be of an illustrated linear type or other regular or irregular shapes, but the separation mechanism is needed.

Figure 2:
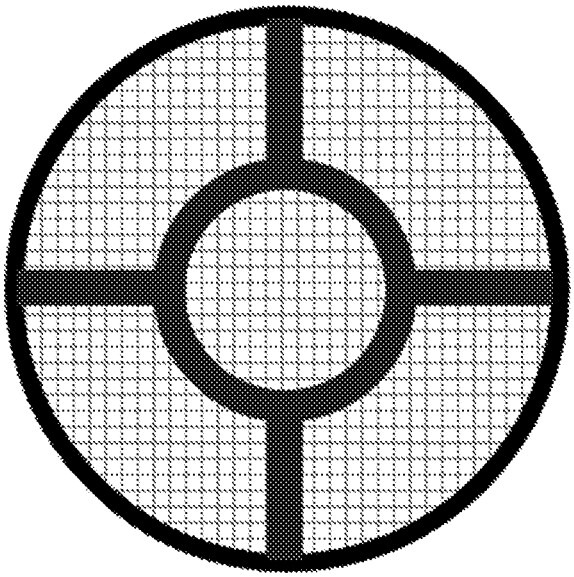
FIG. 2 is a simple structural schematic diagram of Embodiment 2 of the present disclosure.

FIG. 2 shows a shape of a burner component of Embodiment 2. The main frame is circular, and the internal stable burning isolation strip is circular. The outer circle is in connection with the main frame by means of a plurality of stable burning isolation strips so as to divide the area into a preset shape.

Figure 3:
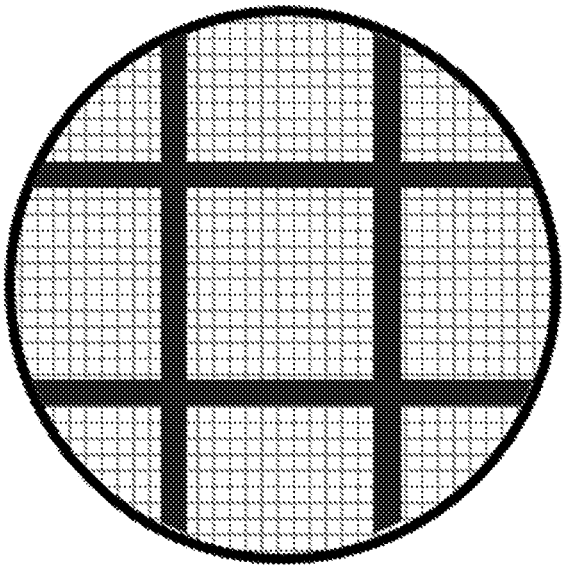
FIG. 3 is a simple structural schematic diagram of Embodiment 3 of the present disclosure.

FIG. 3 shows a shape of a burner component of Embodiment 3. The main frame is circular, and the interior thereof is divided by a plurality of stable burning isolation strips.

Figure 4:
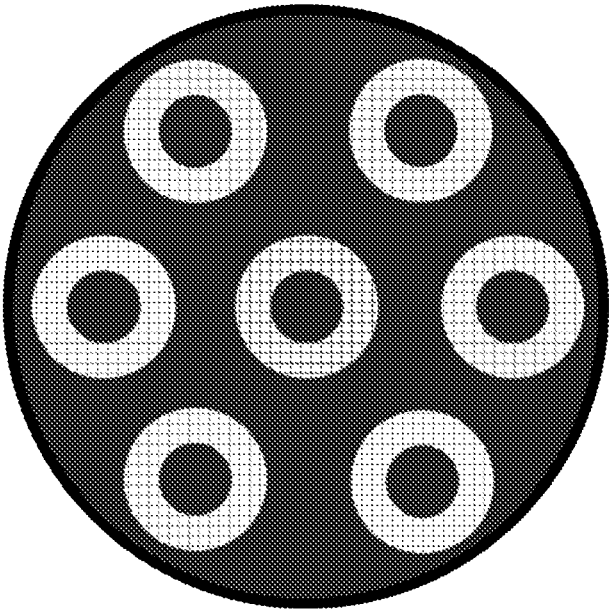
FIG. 4 is a simple structural schematic diagram of Embodiment 4 of the present disclosure.

FIG. 4 shows a shape of a burner component of Embodiment 4. The main frame is circular, the ventilation area is annular, and the interior is divided by a plurality of stable burning isolation strips.

The stable burning isolation strip may be arranged in various modes, for example, the stable burning isolation strip is attached to a surface of the main frame, or penetrates the main frame in a thickness direction, or extends into the main frame by a preset length. Its main purpose is to separate the main frame. In a traditional process that fuel gas is input into the gas channel in the main frame by an air blower/exhaust fan, due to spiral action of the fan, the output air is high in flow speed in a local area and low in flow speed in another local area, causing an erratic flame, and therefore burning is incomplete. In the present disclosure, the main frame is divided into a plurality of areas by the stable burning isolation strips. Although burning powers of the adjacent areas are still different, the adjacent flames may be unaffected, so as to achieve stable burning.

It also can be seen from a comparison diagram of comparison in FIG. 6, the burning flame in the present disclosure is blue, and the adjacent flames burns stably. FIG. 6 further shows a pollutant emission amount measured by means of experiments. An emission standard of a gas boiler in China is that a nitrogen oxide emission amount ≤200 $mg/m^3$, the standard in some regions is higher, for example, ≤80 $mg/m^3$ or ≤30 $mg/m^3$; and the nitrogen oxide emission amount in the present disclosure is ≤15 $mg/m^3$. The present disclosure has a low overall manufacturing cost and low pollutant emission. In actual production and life, the present disclosure may be used in various fields related to fuel gas, for example, gas stoves, gas water heaters, gas boilers, gas wall-hanging stoves, etc., and have a desirable effect of reducing pollutant emission.

In the present disclosure, materials of the burner component include non-metal material and metal material. For example, the non-metal material may be honeycomb ceramic, and it is to be noted that an application principle of an existing honeycomb ceramic porous burner is intra-hole burning, which is different from a principle of the present disclosure (as for a honeycomb ceramic porous structure, burning is firstly carried out in a flame form, after a ceramic plate is heated by the flame, burning returns to a channel and is completed in the channel; and the burner is in a red hot state, generates a large amount of infrared radiation, and is also called an infrared burner; and the burner is prone to burst after being rapidly cooled and rapidly heated, burning power is limited, and the burner cannot be used as a high-power heater).

Figure 5:
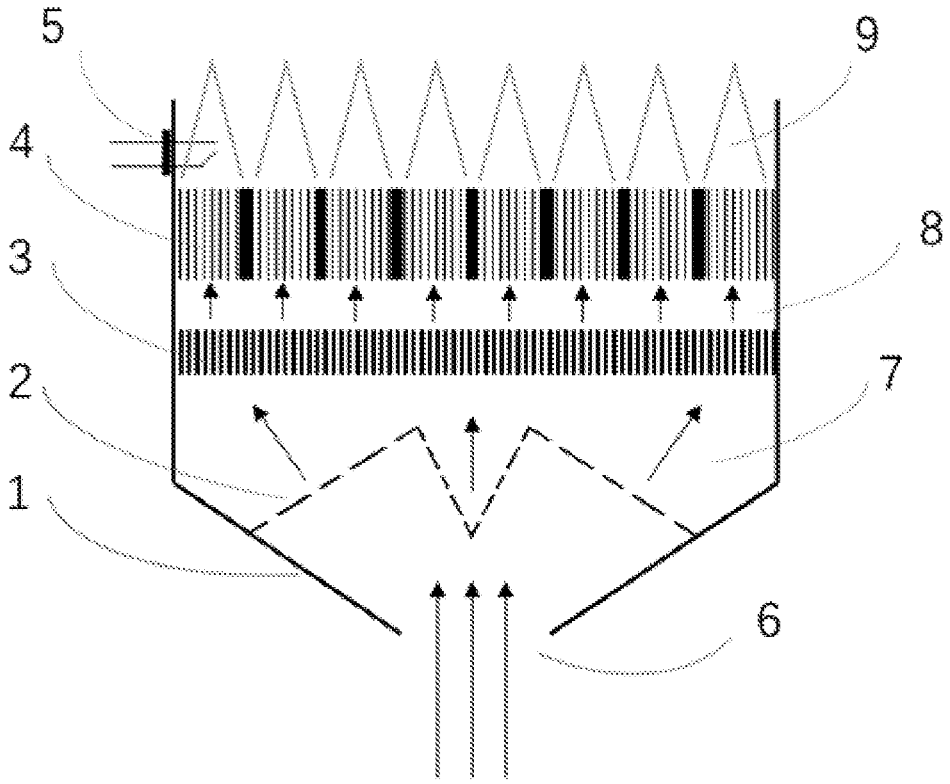
FIG. 5 is a structural schematic diagram of a burner in an embodiment of the present disclosure.

The present disclosure also provides a burner having the said burning component, as shown in FIG. 5, which is one of the embodiments. The burner includes a housing 1 having a gas inlet 6. The fuel gas may be send into the gas inlet together with the air through a blower, or the fuel gas may be extracted together with the air through the exhaust fan provided at the gas outlet. The burner component of the present disclosure is disposed between the gas inlet and the outlet of the mixed gas of fuel gas and air. The burner component serves as a micro-channel rectification burner. A first gas pressure equalizing mixing cavity 7 is disposed between the gas inlet and the micro-channel rectification burner 4. By means of an air distributor 2 disposed in the first gas pressure equalizing mixing cavity, the fuel gas and the air are uniformly distributed primarily, and an outlet of the mixed gas of the fuel gas and the air is an outlet of the micro-channel rectification burner. An ignition mechanism is set here, and the fuel gas passing through the micro-channel rectification burner is ignited to form a hollow conical flame 9. In this embodiment, the ignition needle 5 may be an ignition mechanism.

In other optional implementations, a micro-channel rectifier 3 may also be disposed between the micro-channel rectification burner 4 and the gas inlet, so that a second gas pressure equalizing mixing cavity 8 is formed therebetween to obtain a better rectification effect.

The gas inlet is an inlet of the mixed gas of fuel gas and air.

At last, it should be noted that the above various embodiments are merely intended to illustrate the technical solution of the present disclosure and not to limit the same; although the present disclosure has been described in detail with reference to the foregoing embodiments, it should be understood by those ordinary skilled in the art that the technical solutions described in the foregoing embodiments may be modified or equivalents may be substituted for some or all of the technical features thereof; and the modification or substitution does not make the essence of the corresponding technical solution deviate from the scope of the technical solution of each embodiment of the present disclosure.

The invention claimed is:

1. A burner component comprising:

a main frame comprising a plurality of through holes enclosed by a main frame wall, wherein the plurality of through holes are evenly distributed across the main frame, each of the plurality of through holes is perpendicular to and has an opening at a planar surface of the main frame; and at least one stable burning isolation strip that is attached to the planar surface of the main frame, wherein the at least one stable burning isolation strip covers openings of through holes at the planar surface that are disposed underneath the at least one stable burning isolation strip, thereby dividing the planar area into at least two ventilation areas, and a width D1 of the at least one stable burning isolation strip on the planar surface of the main frame is equal to a total length of a distance across 3 to 10 through holes on the planar surface so that, during operation, each ventilation area has a flame that is separated and independent from a flame in an adjacent ventilation area.

2. The burner component according to claim 1, wherein the at least one stable burning isolation strip is attached to the planar surface of the main frame.

3. The burner component according to claim 1, wherein the at least one stable burning isolation strip extends into the main frame perpendicular to the planar direction of the main frame so as to form a wall to a portion of the plurality of through holes adjacent to the at least one stable burning isolation strip.

4. The burner component according to claim 1, wherein each of the plurality of through holes has a cross-sectional area $S_{hole}$ satisfying $0.1\ mm^2 \leq S_{hole} \leq 9\ mm^2$.

5. The burner component according to claim 1, wherein the stable burning isolation strip is continuous or discontinuous on the planar surface of the burner component, and a discontinuous section has a width $D_2$ equal to a total length a distance across one or two through holes.

6. The burner component according to claim 1, wherein the stable burning isolation strip has a width $D_1$ satisfying $2\ mm \leq D_1 \leq 50\ mm$.

7. The burner component according to claim 1, wherein each ventilation area has a cross-sectional area $S_n$ satisfying $30\ mm^2 \leq S_n \leq 22500\ mm^2$.

8. The burner component according to claim 1, wherein one of the plurality of through holes has a wall thickness, $d_{hole}$ that satisfies $0.03\ mm \leq d_{hole} \leq 3\ mm$, and the main frame has a wall thickness $d_{outer}$ satisfying $0.03\ mm \leq d_{outer} \leq 50\ mm$.

9. The burner component according to claim 1, wherein the ventilation area has a thickness h in the direction perpendicular to the planar surface of the main frame of $4\ mm \leq h \leq 1000\ mm$.

10. A burner comprising the burner component according to claim 1.

* * * * *